US007271539B2

(12) United States Patent
Kwon et al.

(10) Patent No.: US 7,271,539 B2
(45) Date of Patent: Sep. 18, 2007

(54) PLASMA DISPLAY PANEL

(75) Inventors: Jae-Ik Kwon, Suwon-si (KR); Kyoung-Doo Kang, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 211 days.

(21) Appl. No.: 11/128,103

(22) Filed: May 11, 2005

(65) Prior Publication Data

US 2005/0253518 A1 Nov. 17, 2005

(30) Foreign Application Priority Data

May 12, 2004 (KR) ..... 10-2004-0033391

(51) Int. Cl.
*H01J 17/49* (2006.01)

(52) U.S. Cl. ..... 313/586; 313/582; 313/584

(58) Field of Classification Search ..... 313/582, 313/584, 586

See application file for complete search history.

(56) References Cited

U.S. PATENT DOCUMENTS 6,084,349 A * 7/2000 Ueoka et al. ..... 313/587
2004/0207325 A1* 10/2004 Kushida et al. ..... 313/586

FOREIGN PATENT DOCUMENTS

JP 2001-163637 6/2001
JP 2004-063241 2/2004

* cited by examiner

*Primary Examiner*—Vip Patel
(74) *Attorney, Agent, or Firm*—Knobbe Martens Olson & Bear LLP

(57) ABSTRACT

Disclosed is a plasma display panel where the shape of the phosphor layer within the discharge cell is optimized to enhance the discharge stability and the luminescence efficiency. In one embodiment, the plasma display panel includes a first substrate and a second substrate facing each other, display electrodes formed on the first substrate, address electrodes formed corresponding to the display electrodes, barrier ribs arranged between the first substrate and the second substrate such that discharge cells are formed at the locations where the display electrodes and the address electrodes correspond to each other, phosphor layers formed within the discharge cells, and a porous dielectric layer formed between the phosphor layers and the second substrate.

18 Claims, 3 Drawing Sheets

PLASMA DISPLAY PANEL

CROSS-REFERENCE TO RELATED APPLICATION

This application claims the benefit of and priority to Korean Patent Application No. 10-2004-0033391, filed on May 12, 2004 in the Korean Intellectual Property Office, the entire disclosure of which is incorporated herein by reference.

BACKGROUND OF THE INVENTION (a) Field of the Invention

The present invention relates to a plasma display panel (referred to hereinafter simply as a "PDP") which involves enhanced discharge stability and luminescence efficiency in displaying images.

(b) Description of Related Technology

Generally, a PDP is a display device which displays images using red, green, and blue (R, G, and B) visible rays. The visible rays are generated by exciting phosphors with the use of vacuum ultraviolet rays, which are radiated from plasma obtained through gas discharge. The PDP can provide a large-sized screen of sixty inches or greater with a thickness of only 10 cm or less. The PDP is a self light-emitting display device such as a CRT, and does not suffer distortion due to color representation or viewing angle. Furthermore, compared to an LCD, the PDP involves simplified processing steps, economical production costs, and excellent productivity, and hence has been spotlighted as a flat panel display for TV and industrial purposes.

In an AC PDP (Alternating Current PDP), address electrodes are formed on a rear substrate in one direction, and a dielectric layer is formed on the entire surface of the rear substrate covering the address electrodes. Stripe-patterned barrier ribs are formed on the dielectric layer such that they are disposed between neighboring address electrodes, and red, green, and blue (R, G, and B) phosphor layers are formed between neighboring barrier ribs.

A pair of display electrodes, having transparent electrodes and bus electrodes, are formed on the surface of a front substrate facing the rear substrate. A dielectric layer and an MgO protective layer are generally sequentially formed on the entire surface of the front substrate while covering the display electrodes.

The discharge cells are formed at the crossed regions of the address electrodes of the rear substrate and the pair of display electrodes of the front substrate.

Millions of unit discharge cells are arranged within the PDP in the shape of a matrix. Memory-based driving is conducted to simultaneously drive the AC PDP discharge cells arranged in the matrix shape.

Specifically, a potential difference of at least a predetermined voltage should be generated between the X electrode (sustain electrode) and the Y electrode (scanning electrode) of the display electrodes to generate the discharge. The predetermined voltage is called a firing voltage Vf. When the scan voltage is applied to the Y electrode and the address voltage to the address electrode, a discharge is fired while forming plasma within a designated discharge cell. Also, the electrons and ions existent in the plasma are transferred to the electrode with opposite polarity, thereby creating an electrical current flow.

In addition, a dielectric layer is deposited on the respective electrodes of the AC PDP, and most of the transferred space charges are deposited on the dielectric layer with opposite polarity. Accordingly, the net space potential generated between the Y electrode and the address electrode becomes smaller than the initially applied address voltage Va, thereby weakening the discharge and dissipating the address discharge. At this time, a relatively small amount of electrons are deposited on the X electrode, and a relatively large amount of electrons are deposited on the Y electrode. The charges deposited on the dielectric layer covering the X and the Y electrodes are called wall charges Qw. The space voltage formed between the X and the Y electrodes due to the wall charges Qw are called a wall voltage Vw.

Under the application of a predetermined voltage (the sustain voltage Vs) between the X and the Y electrodes, when the sum Vs+Vw of the sustain voltage Vs and the wall voltage Vw is higher than the firing voltage Vf, the discharge is generated within the discharge cell while generating vacuum ultraviolet (VUV) rays. The vacuum ultraviolet rays excite the corresponding phosphors so that visible rays are emitted through the transparent front substrate.

In contrast, when the address discharge is not made between the Y electrode and the address electrode (that is, with no application of the address voltage Va), the wall charges are not deposited between the X and Y electrodes, and accordingly, the wall voltage is not present between the X and Y electrodes. In this case, only the sustain voltage Vs applied between the X and Y electrodes is formed within the discharge cell. As the sustain voltage Vs is lower than the firing voltage Vf, the gas discharge between the X and Y electrodes does not occur.

The PDP is generally influenced by discharge stability and display brightness depending upon the shape of the phosphors formed at the barrier ribs of the discharge cells. Furthermore, the vacuum ultraviolet rays generated due to the gas discharge do not excite the entire phosphor layers, formed within a given discharge cells, and being very thick, but only excite one or two of the outermost layers of phosphors so that the luminescence efficiency of the PDP is reduced.

SUMMARY OF CERTAIN INVENTIVE EMBODIMENTS

One aspect of the present invention provides a plasma display panel which optimizes the shape of the phosphors within the discharge cells, thereby enhancing the discharge stability and the luminescence efficiency.

Another aspect of the invention provides a PDP including the following features.

In one embodiment, the PDP includes a first substrate and a second substrate facing each other, display electrodes formed on the first substrate, address electrodes formed corresponding to the display electrodes, barrier ribs arranged between the first substrate and the second substrate such that discharge cells are formed at the locations where the display electrodes and the address electrodes correspond to each other, phosphor layers formed within the discharge cells, and a porous dielectric layer formed between the phosphor layers and the second substrate.

In one embodiment, the barrier ribs are formed of a closed barrier structure.

In one embodiment, the phosphor layer has a portion placed at the barrier rib of the discharge cell with a first thickness, and a portion placed at the bottom of the discharge cell with a second thickness greater than the first thickness.

In one embodiment, the dielectric layer is formed of a porous dielectric material.

In another embodiment, the dielectric layer has a porous film including a plurality of pores.

In another embodiment, the dielectric layer has a porous film facing the phosphor layer, and may be formed only at a portion of the dielectric layer facing the phosphor layer.

In one embodiment, the porous film has a single or double-layered structure with a thickness of about one to two times greater than the diameter of a phosphor of a plasma particle of the phosphor layer.

In another embodiment, the porous film has a thickness about as large as the minimum diameter of the pores of the dielectric layer.

In one embodiment, the pore has a diameter of about 2 μm to about 4 μm amounting to the particle diameter of the phosphors.

BRIEF DESCRIPTION OF THE DRAWINGS

Embodiments of the present invention will be described with reference to the accompanying drawings.

DETAILED DESCRIPTION OF CERTAIN INVENTIVE EMBODIMENTS

Embodiments of the present invention will be described more fully hereinafter with reference to the accompanying drawings.

Figure 1:
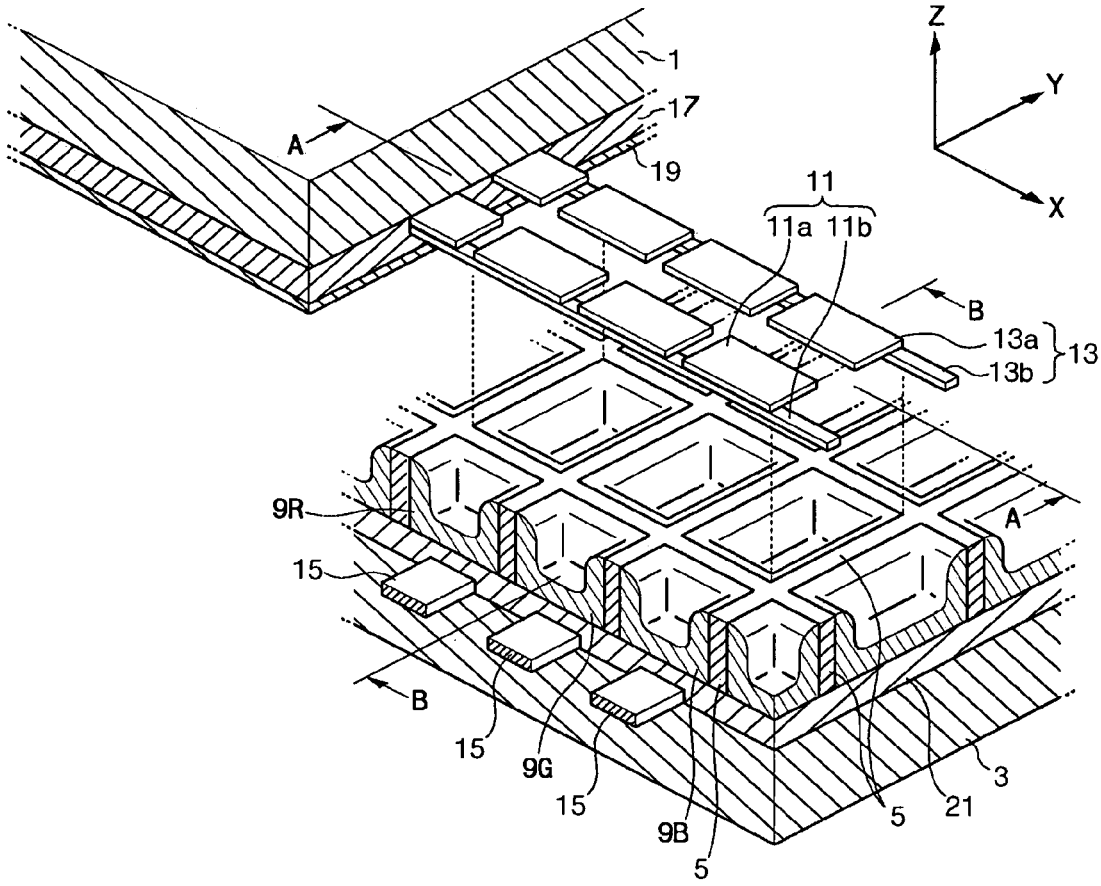
FIG. 1 is a schematic partial sectional view of a PDP according to an embodiment of the present invention.

FIG. 1 is a schematic partial sectional view of a PDP according to an embodiment of the present invention.

As shown in FIG. 1, the PDP includes a first substrate 1 (referred to hereinafter as a "front substrate"), and a second substrate 3 (referred to hereinafter as a "rear substrate") sealed to the front substrate 1 facing the rear substrate 3. The space between the front substrate 1 and the rear substrate 3 is filled with an inert gas, such as Ne or Xe. A plurality of barrier ribs 5 are arranged between the front substrate 1 and the rear substrate 3 to partition a plurality of discharge cells 7R, 7G, and 7B. Red, green, and blue phosphors R, G, and B are deposited within the discharge cells 7R, 7G, and 7B to form phosphor layers 9R, 9G, and 9B. In one embodiment, the portions of the phosphor layers 9R, 9G, and 9B formed at the barrier ribs 5 of the discharge cells 7R, 7G, and 7B have a thickness equal to or less than that of the portions of the phosphor layers 9R, 9G, and 9B formed at the bottom of the discharge cells, thereby preventing the distortion of the discharge field at the barrier ribs 5 of the discharge cells 7R, 7G, and 7B due to the phosphors.

A plurality of display electrodes 11 and 13 are formed on the front substrate 1 in the direction of the x axis of the drawing to generate a plasma discharge between the front substrate 1 and the rear substrate 3. A plurality of address electrodes 15 are longitudinally formed in the direction of the y axis of the drawing while crossing the display electrodes 11 and 13.

The display electrodes 11 and 13 and the address electrodes 15 are correspondingly arranged at the respective discharge cells 7R, 7G, and 7B partitioned by the barrier ribs 5 to generate the plasma discharge.

The display electrodes 11 and 13 are generally formed of X and Y electrodes 11 and 13 facing each other such that they provide an address discharge in association with the address electrodes 15, and then, a sustain discharge within the discharge cells 7R, 7G, and 7B. When the address voltage is applied to the address electrodes 15 and the scan voltage to the Y electrodes 13, the address discharge is generated between the address and Y electrodes 15 and 13. Thereafter, when the sustain voltage is applied to the X and Y electrodes 11 and 13, the sustain discharge is generated between the X and Y electrodes 11 and 13.

In one embodiment, the X and Y electrodes 11 and 13 are formed of i) transparent electrodes 11*a* and 13*a*, which are protruded toward the center of the discharge cells 7R, 7G, and 7B (see FIG. 3), and ii) bus electrodes 11*b* and 13*b* for supplying the electrical current to the transparent electrodes 11*a* and 13*a*. The transparent electrodes 11*a* and 13*a* are configured to generate the plasma discharge within the discharge cells 7R, 7G, and 7B. In one embodiment, the transparent electrodes 11*a* and 13*a* are formed of a transparent electrode material, such as indium tin oxide (ITO), so as to enhance the display brightness. The bus electrodes 11*b* and 13*b* compensate for the high resistance of the transparent electrodes 11*a* and 13*a* by enhancing the overall conductivity. In one embodiment, the bus electrodes 11*b* and 13*b* are formed of a metallic electrode material, such as Al.

Figure 3:
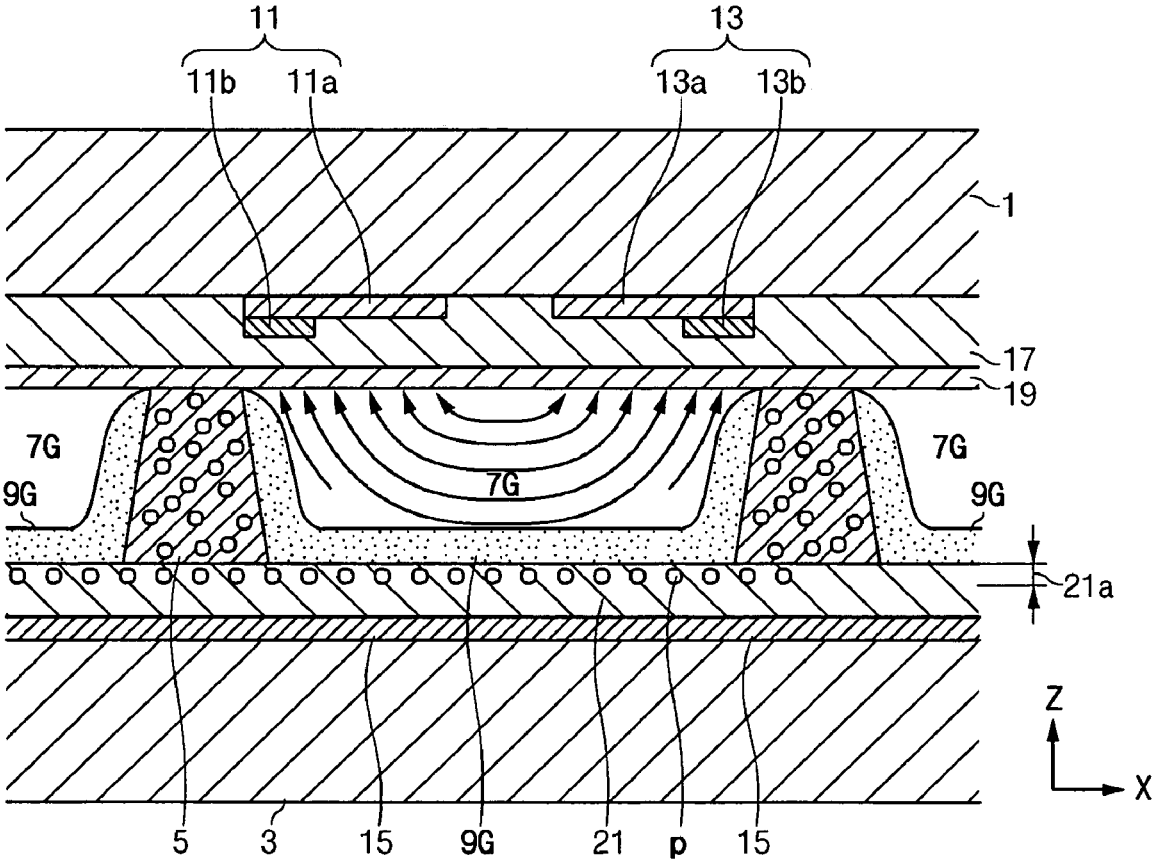
FIG. 3 is a cross sectional view of the PDP taken along the line B-B of FIG. 1.

The display electrodes 11 and 13 are formed of pairs of X and Y electrodes 11 and 13 facing each other. In one embodiment, a pair of bus electrodes 11*b* and 13*b* are linearly formed parallel to each other corresponding to the respective discharge cells 7R, 7G, and 7B. In one embodiment, the transparent electrodes 11*a* and 13*a* are protruded from the respective bus electrodes 11*b* and 13*b* to the center of the respective discharge cells 7R, 7G, and 7B as shown in FIG. 3. The transparent electrodes 11*a* and 13*a* face each other by pairs in the direction of the address electrodes 15, that is, in the direction of the y axis of the drawing. The display electrodes 11 and 13 are overlaid by a first dielectric layer 17 and an MgO protective layer 19.

In one embodiment, the address electrodes 15, configured to provide the address discharge in association with Y electrodes 13 of the display electrodes 11 and 13, are formed at the rear substrate 3. In another embodiment, the address electrodes 15 may be formed at the front substrate 1 or the barrier ribs 5. In the latter case, the address electrodes 15 do not cross the display electrodes 11 and 13, but proceed parallel to the display electrodes 11 and 13. In another embodiment, the address electrodes 15 may be arranged in various manners such that they can easily provide the address discharge in association with the display electrodes 11 and 13.

The barrier ribs 5 are generally disposed between the front substrate 1 and the rear substrate 3. The barrier ribs 5 proceed parallel to each other to partition the discharge cells 7R, 7G, and 7B where the plasma discharge occurs. As shown in FIG. 1, each of the barrier ribs 5 has two pairs of perpendicular portions formed in the directions of the x and y axes of the drawing, respectively, to form a closed barrier rib structure. In one embodiment, the barrier ribs 5 may be stripe-patterned proceeding either in the direction of the x axis or in the direction of the y axis. The respective address electrodes 15 are arranged between the neighboring portions of the barrier ribs 5 proceeding in the direction of the y axis. The barrier ribs 5 are typically formed of a porous material, and absorb the phosphors when the phosphors printed within the discharge cells 7R, 7G, and 7B are dried during the process of manufacturing a PDP.

A second dielectric layer 21, configured to protect the address electrodes 15, is disposed between the barrier ribs 5 and the rear substrate 3. The second dielectric layer 21 covers the address electrodes 15 such that it forms wall charges at the discharge cells 7R, 7G, and 7B due to the address voltage applied to the address electrodes 15 of the rear substrate 3 and the scan voltage applied to the Y electrodes 13 to create the address discharge.

Figure 2:
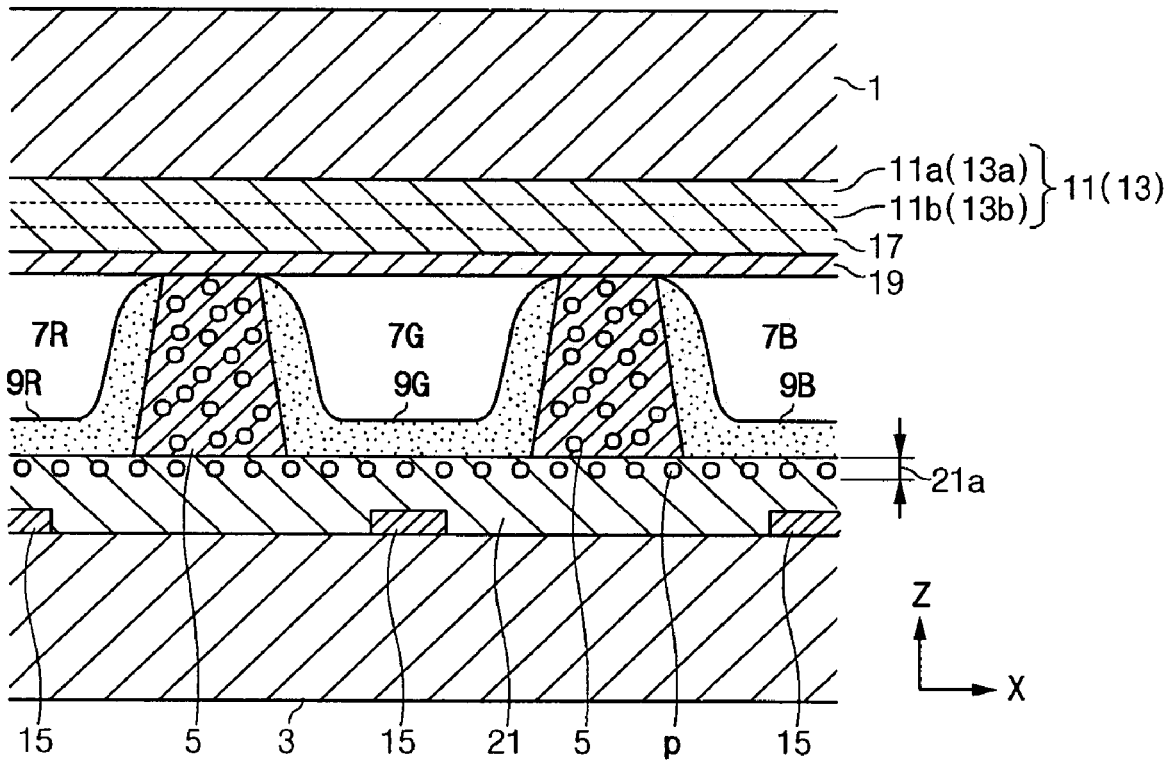
FIG. 2 is a cross sectional view of the PDP taken along the line A-A of FIG. 1.

FIG. 2 is a cross sectional view of the PDP taken along the line A-A of FIG. 1, and FIG. 3 is a cross sectional view of the PDP taken along the line B-B of FIG. 1.

In one embodiment, the second dielectric layer 21 has a plurality of pores p, and covers the address electrodes 15 as illustrated in FIGS. 2 and 3. In this embodiment, the second dielectric layer 21 is formed of a porous dielectric material, and has a porous film 21*a* including a plurality of pores. In other words, when the firing temperature profile is varied rapidly in the firing process, more pores are formed within the second dielectric layer 21 and the surface of the second dielectric layer 21 becomes rough, thereby a porous dielectric layer being formed. In another embodiment, the second layer 21 may be made of other materials, for example, a non-porous layer or non-dielectric layer, which can absorb at least a portion of the phosphors when they are being dried.

When the phosphors printed at the discharge cells 7R, 7G, and 7B are dried, the porous film 21*a* greatly absorbs the phosphors, as does the barrier ribs 5. Conventionally, the second dielectric layer was not porous, and during the dry processing, it did not absorb phosphors while the porous barrier ribs absorbed and/or attracted the phosphors. The barrier ribs absorbed and/or attracted not only the phosphors formed at the sides of a discharge cell, but also the phosphors formed at the bottom of the discharge cell. Accordingly, more phosphors were accumulated at the sides of the discharge cell than the bottom. This adversely affected the discharge stability and the display brightness of a PDP.

In one embodiment of the invention, the phosphor layers 9R, 9G, and 9B formed at the bottom of the discharge cells 7R, 7G, and 7B have a thickness that is relatively greater than those of a conventional PDP. In another embodiment, with the use of the porous film 21*a*, about the same amount of phosphors printed at the discharge cells 7R, 7G, and 7B can be absorbed and/or attracted to both the barrier ribs 5 and the bottom. In another embodiment, a greater amount of phosphors can be absorbed and/or attracted to the bottom than the barrier ribs 5. In these embodiments, the thickness of the phosphor layers 9R, 9G, and 9B at the sides is equal to or less than that of the phosphor layers 9R, 9G, and 9B at the bottom. That is, compared to the thickness of the phosphor layers 9R, 9G, and 9B formed at the barrier ribs of the discharge cells 7R, 7G, and 7B, the phosphor layers 9R, 9G, and 9B formed at the bottom of the discharge cells 7R, 7G, and 7B have a relatively greater thickness. According to this embodiment, the phosphor layers 9R, 9G, and 9B are sufficiently excited by vacuum ultraviolet rays so that the discharge is stabilized, and the luminescence efficiency is enhanced.

In one embodiment, the porous film 21*a* may be formed across the entire area of the dielectric layer 21 based on the plane direction of x-y. In another embodiment, the porous film 21*a* is formed only at the portions of the dielectric layer 21 facing the phosphor layers 9R, 9G, and 9B excited by the vacuum ultraviolet rays.

In another embodiment, the porous film 21*a* may be formed across the entire area of the dielectric layer 21 based on the direction of the z axis. In one embodiment, the porous film 21*a* is formed of a single or double-layered structure. In one embodiment, the porous film 21*a* has a thickness which is about one to two times larger than the diameter of the phosphor particles, or about as large as the minimum diameter of the pores. For example, if the diameter of the phosphor particles is about 3 μm, the respective pores of the porous film 21*a* can be correspondingly formed of a diameter of about 2 μm to about 4 μm.

The vacuum ultraviolet rays, generated due to the plasma discharge, typically excite the surface area of the phosphor layers 9R, 9G, and 9B, or portions thereof with a thickness of about one to two times larger than the diameter of the phosphor particles. In one embodiment, the porous film 21*a* is thick enough so that all formed phosphor layers can be excited by the vacuum ultraviolet rays. In the case of the phosphor layers 9R, 9G, and 9B being very thin, in the absence of the porous film 21*a*, the phosphor layers 9R, 9G, and 9B do not emit sufficient light. In contrast, in the case of the phosphor layers 9R, 9G, and 9B being very thick, in the presence of the porous film 21*a*, the phosphor layers 9R, 9G, and 9B may reduce the discharge space within the discharge cells 7R, 7G, and 7B, thereby hindering the light emission capability of the cells.

Accordingly, in one embodiment, the thickness of the phosphor layers 9R, 9G, and 9B formed at the barrier ribs 5 of the discharge cells 7R, 7G, and 7B is established to be equal or less than that of the phosphor layers 9R, 9G, and 9B formed at the bottom thereof so that the interference of the discharge field is prevented. Furthermore, the phosphor layers 9R, 9G, and 9B formed at the bottom can have sufficient light emission, thereby enhancing the brightness of the cells.

As listed in Table 1, a structure with a porous film 21*a* formed at the second dielectric layer 21, according to an Example (PDP according to one embodiment of the invention), involved enhanced discharge stability and brightness, compared to a structure with no porous film according to a Comparative Example (conventional PDP).

TABLE 1

| | | Conventional PDP Example | Inventive Embodiment Example |
|---|---|---|---|
| Brightness | R | 179-190 | 210-229 |
| | G | 457-580 | 560-587 |
| | B | 73-88 | 90-94 |
| Voltage margin | R minimum volt. | 41 | 40 |
| | G minimum volt. | 56 | 46 |
| | B minimum volt. | 44 | 42 |

Table 1 lists the measurement results of the PDPs where Ne gas mixed with 7% of Xe was charged into the discharge cells 7R, 7G, and 7B at 500 Torr, the sustain voltage was 180V, and the reset voltage was 170V. That is, the PDP according to the Example involved a higher brightness and a lower minimum voltage margin than those of the PDP according to the Comparative Example, and had enhanced discharge stability.

In order to enhance the luminescence efficiency of the PDP, a closed barrier rib structure is selected. With the closed barrier rib structure rather than the stripe-patterned barrier rib structure, the thickness of the phosphor layers 9R, 9G, and 9B formed at the bottom of the discharge cells 7R, 7G, and 7B generally becomes less than that of the phosphor layers 9R, 9G, and 9B formed at the barrier ribs 5 as in the conventional PDP. In one embodiment of the invention, the porous film 21*a* formed at the second dielectric layer 21 can exert greater effects with the closed barrier rib structure since the bottom thickness of the phosphor layer can be compensated so as to be equal or greater than the side thickness of the layer.

As described above, one embodiment of the invention includes a dielectric layer having a porous film facing the phosphor layers of the discharge cells. Even though the phosphors are dried within the discharge cells, the thickness of the phosphor layers formed at the bottom of the discharge cells is established to be equal to or greater than that of the phosphor layers formed at the barrier ribs. Also, the shape of the phosphors within the discharge cells is optimized, thereby preventing the distortion of the discharge field, and enhancing the discharge stability. Furthermore, all the phosphors within the discharge cells can be excited to thereby enhance the luminescence efficiency.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A plasma display panel, comprising:

a first substrate and a second substrate facing each other;

a plurality of display electrodes formed on the first substrate;

a plurality of address electrodes formed corresponding to the display electrodes;

a plurality of barrier ribs, arranged between the first substrate and the second substrate, configured to form a plurality of discharge cells;

at least one phosphor layer formed on side portions and a bottom portion of each of the discharge cells, wherein the bottom portion is directed toward the second substrate; and a porous dielectric layer formed between the at least one phosphor layer and the second substrate, wherein the thickness of the at least one phosphor layer formed on the side portions is less than that of the phosphor layer formed on the bottom portion.

2. The plasma display panel of claim 1, wherein the barrier ribs are formed of a closed barrier structure.

3. The plasma display panel of claim 1, wherein the dielectric layer has a porous film including a plurality of pores.

4. The plasma display panel of claim 3, wherein the porous film has a single or double-layered structure.

5. The plasma display panel of claim 3, wherein the porous film has a thickness of about one to two times greater than the diameter of a phosphor particle of the phosphor layer.

6. The plasma display panel of claim 3, wherein the porous film has a thickness of about as large as the minimum diameter of the pores of the dielectric layer.

7. The plasma display panel of claim 1, wherein the dielectric layer has a porous film facing the phosphor layer.

8. The plasma display panel of claim 7, wherein the porous film is formed only at the portion of the dielectric layer facing the phosphor layer.

9. The plasma display panel of claim 1, wherein at least a portion of the pores of the dielectric layer has a diameter of about 2 μm to about 4 μm.

10. A plasma display panel, comprising:

a phosphor layer formed on side portions and a bottom portion of each of a plurality of discharge cells, wherein the side portions contact barrier ribs and the bottom portion is directed toward a rear substrate of the display panel through which visible light is not emitted; and a layer, formed between the phosphor layer and the rear substrate, configured to absorb and/or attract at least a portion of the phosphor layer formed on the side portions during a drying process of the phosphor layer such that the thickness of the phosphor layer formed on the side portions is less than that of the phosphor layer formed on the bottom portion.

11. The plasma display panel of claim 10, wherein the drying processing includes screen printing.

12. The plasma display panel of claim 10, wherein the layer includes a porous dielectric layer.

13. The plasma display panel of claim 12, wherein at least a portion of the pores of the dielectric layer has a diameter of about 2 μm to about 4 μm.

14. A plasma display panel, comprising:

a porous dielectric layer formed between a phosphor layer and a rear substrate of the plasma display panel, wherein the rear substrate is opposed to a front substrate through which visible light is emitted, wherein the thickness of the phosphor layer formed on side portions of a discharge cell is less than the thickness of the phosphor layer formed on a bottom portion of the discharge cell, wherein the bottom portion is directed toward the rear substrate.

15. A display device having a plasma display panel, the display panel comprising:

a plurality of barrier ribs, arranged between first and second substrates, configured to partition a plurality of discharge cells, wherein visible light is not emitted through the second substrate;

a phosphor layer formed within each of the discharge cells, wherein the thickness of the phosphor layer formed on side portions of a discharge cell is less than the thickness of the phosphor layer formed on a bottom portion of the discharge cell, wherein the bottom portion is directed toward the rear substrate; and a layer, formed between the phosphor layer and the second substrate, configured to absorb and/or attract at least a portion of the phosphor layer during a drying process of the phosphor layer.

16. The display device of claim 15, wherein the layer includes a porous dielectric layer.

17. The display device of claim 15, wherein the layer includes a porous film which is formed only at the portion of the dielectric layer facing the phosphor layer.

18. A plasma display panel, comprising:

a first substrate and a second substrate facing each other;

a plurality of display electrodes formed on the first substrate;

a plurality of address electrodes formed corresponding to the display electrodes;

a plurality of porous barrier ribs, arranged between the first substrate and the second substrate, configured to form a plurality of discharge cells;

at least one phosphor layer formed on side portions and a bottom portion of each of the discharge cells; and a porous dielectric layer formed between the at least one phosphor layer and the second substrate.

* * * * *